US008821126B2

(12) United States Patent
Oleson et al.

(10) Patent No.: US 8,821,126 B2
(45) **Date of Patent: *Sep. 2, 2014**

(54) ANGLED AIRFOIL EXTENSION FOR FAN BLADE

(75) Inventors: Richard A. Oleson, Lexington, KY (US); Richard M. Aynsley, Lexington, KY (US); Dale R. Jury, Richmond, KY (US)

(73) Assignee: Delta T Corporation, Lexington, KY (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/428,267

(22) Filed: Mar. 23, 2012

(65) Prior Publication Data

US 2012/0177500 A1 Jul. 12, 2012

Related U.S. Application Data

(63) Continuation of application No. 12/038,873, filed on Feb. 28, 2008, now Pat. No. 8,162,613.

(60) Provisional application No. 60/892,339, filed on Mar. 1, 2007.

(51) Int. Cl.
*F04D 29/38* (2006.01)

(52) U.S. Cl.
USPC ..... 416/210 R; 416/228

(58) Field of Classification Search
USPC ..... 416/146 R, 210 R, 211, 219 R, 228, 235
See application file for complete search history.

(56) References Cited

U.S. PATENT DOCUMENTS

| | | | | |
|---|---|---|---|---|
| 871,729 | A | 11/1907 | McChord, Jr. | |
| 1,041,913 | A | 10/1912 | Tyson | |
| 2,014,032 | A | 9/1935 | Sharpe et al. | |
| 3,524,712 | A | 8/1970 | Petrie et al. | |
| 3,721,507 | A | 3/1973 | Monteleone | |
| 4,174,924 | A | 11/1979 | Smithson, Jr. | |
| 4,248,572 | A | 2/1981 | Fradenburgh | |
| 4,324,530 | A | 4/1982 | Fradenburgh et al. | |
| 4,334,828 | A | 6/1982 | Moffitt | |
| 4,631,335 | A * | 12/1986 | Scola et al. | 528/353 |

(Continued)

FOREIGN PATENT DOCUMENTS

| | | |
|---|---|---|
| DE | 3 819 145 | 12/1989 |
| EP | 1 619 391 | 1/2006 |

(Continued)

OTHER PUBLICATIONS

U.S. Appl. No. 60/892,339, filed Mar. 1, 2007, Oleson.

(Continued)

*Primary Examiner* — Edward Look
*Assistant Examiner* — Christopher R Legendre
(74) *Attorney, Agent, or Firm* — King & Schickli, PLLC

(57) ABSTRACT

An angled fan blade extension includes an attachment portion and an angled portion. The attachment portion is configured to facilitate securing the angled fan blade extension to the distal end of a fan blade. The angled portion is configured to extend from the distal end of the attachment portion, creating an angled extension relative to the fan blade. Adding angular fan blade extensions to fan blades may improve the airflow control, and thereby increase the utility and efficiencies of a fan.

21 Claims, 8 Drawing Sheets

(56) References Cited

U.S. PATENT DOCUMENTS

| | | | | |
|---|---|---|---|---|
| 4,662,823 | A | 5/1987 | Cooke | |
| 4,722,608 | A | 2/1988 | Salzman et al. | |
| 4,892,460 | A * | 1/1990 | Volk | 416/62 |
| 4,968,216 | A | 11/1990 | Anderson et al. | |
| 5,205,710 | A * | 4/1993 | Engels et al. | 416/61 |
| 5,226,783 | A | 7/1993 | Mita | |
| 5,320,494 | A | 6/1994 | Reinfelder et al. | |
| 5,348,253 | A * | 9/1994 | Gratzer | 244/91 |
| 5,520,515 | A * | 5/1996 | Bailey et al. | 416/208 |
| 5,564,901 | A | 10/1996 | Moore | |
| 5,725,355 | A | 3/1998 | Crall et al. | |
| 5,823,480 | A | 10/1998 | La Roche | |
| 5,885,059 | A | 3/1999 | Kovalsky et al. | |
| 6,039,541 | A | 3/2000 | Parker et al. | |
| 6,106,235 | A | 8/2000 | Tettenborn et al. | |
| 6,161,797 | A | 12/2000 | Kirk et al. | |
| 6,244,821 | B1 * | 6/2001 | Boyd et al. | 416/210 R |
| 6,334,705 | B1 | 1/2002 | Weetman | |
| 6,517,315 | B2 | 2/2003 | Belady | |
| 6,565,320 | B1 | 5/2003 | Surls et al. | |
| 6,719,533 | B2 | 4/2004 | Bird | |
| 6,776,578 | B2 | 8/2004 | Belady | |
| 6,884,034 | B1 | 4/2005 | Parker et al. | |
| 6,939,108 | B2 | 9/2005 | Boyd | |
| 7,246,998 | B2 * | 7/2007 | Kovalsky et al. | 416/87 |
| 7,252,478 | B2 * | 8/2007 | Aynsley | 416/204 R |
| 7,284,960 | B2 * | 10/2007 | Aynsley | 416/223 R |
| 7,654,798 | B2 * | 2/2010 | Aynsley | 416/191 |
| 7,934,907 | B2 * | 5/2011 | Aynsley et al. | 416/191 |
| 8,079,823 | B2 * | 12/2011 | Aynsley | 416/242 |
| 8,162,613 | B2 * | 4/2012 | Oleson et al. | 416/210 R |
| 8,177,514 | B2 * | 5/2012 | Hibbard | 416/226 |
| 2002/0182071 | A1 | 12/2002 | Belady | |
| 2003/0095864 | A1 | 5/2003 | Ivanovic | |
| 2006/0018758 | A1 * | 1/2006 | Aynsley | 416/223 R |
| 2006/0104812 | A1 | 5/2006 | Kovalsky et al. | |
| 2006/0187750 | A1 * | 8/2006 | Aldrich et al. | 366/270 |
| 2008/0008596 | A1 | 1/2008 | Aynsley | |
| 2008/0014090 | A1 | 1/2008 | Aynsley et al. | |
| 2009/0208333 | A1 * | 8/2009 | Smith et al. | 416/5 |
| 2010/0104461 | A1 * | 4/2010 | Smith et al. | 417/423.1 |
| 2011/0081246 | A1 * | 4/2011 | Aynsley et al. | 416/204 R |
| 2011/0262278 | A1 * | 10/2011 | Fizer et al. | 416/220 R |
| 2012/0128501 | A1 * | 5/2012 | Hoofard et al. | 416/241 R |
| 2012/0177500 | A1 * | 7/2012 | Oleson et al. | 416/224 |
| 2012/0177509 | A1 * | 7/2012 | Aynsley et al. | 417/63 |

FOREIGN PATENT DOCUMENTS

| | | |
|---|---|---|
| GB | 100 134 | 3/1917 |
| GB | 946 794 | 1/1964 |
| GB | 2 050 530 | 1/1981 |
| GB | 2 198 190 | 6/1988 |
| WO | WO 2006/022812 | 3/2006 |

OTHER PUBLICATIONS

U.S. Appl. No. 60/972,890, filed Sep. 17, 2007, Oleson.
U.S. Appl. No. 60/975,230, filed Sep. 26, 2007, Scherer et al.
U.S. Appl. No. 60/978,860, filed Oct. 10, 2007, Aynsley et al.
U.S. Appl. No. 61/025,852, filed Feb. 4, 2008, Toy.
U.S. Appl. No. 11/046,593, filed Jan. 28, 2005, Aynsley.
U.S. Appl. No. 11/777,344, filed Jul. 13, 2007, Aynsley.
U.S. Appl. No. 11/858,360, filed Sep. 20, 200, Aynsley.
U.S. Appl. No. 11/860,888, filed Sep. 25, 2007, Aynsley, et al.
A Fan for All Seasons, Bell & Howell Information and Learning, American Society of Mechanical Engineers; Mechanical Engineering, vol. 21(12) (Dec. 1999) pp. 58-60.
"Airfoil Design," HVLS, dated Dec. 9, 2002.
Boeing 747-400 Twin-Aisle Jet Airliner, USA Screenshot from http://www.aerospacetechnology.com/projects/747/7473.html, printed on Aug. 11, 2008.
"Dairy Notes," University of California Cooperative Extension (May 1999).
European Search Report dated Aug. 21, 2006 for Application No. EP 05250653.
European Search Report dated Aug. 22, 2006 for Application No. EP 05250654.
European Search Report dated Jul. 1, 2008 for Application No. 05250632.
European Search Report dated Jul. 1, 2008 for Application No. EP 05250653.
European Search Report dated Jul. 1, 2008 for Application No. EP 05250654.
Fairbank et al., "A Large Paddle Fan for Livestock Cooking," Canadian Society of Agricultural Engineering (Jun. 1989).
General Exterior Arrangement 737, Screenshot from http://www.boeing.com/commercial/737family/pf/pf_exterior.html, printed on Aug. 11, 2008.
International Search Report and Written Opinion dated Aug. 19, 2005 for Application No. PCT/US05/02703.
International Search Report, completion dated Jun. 24, 2008 for Application No. PCT/US2008/055266.
Written Opinion dated Jan. 7, 2008 for Application No. PCT/US2008/055266.
Jain et al., "Experimental Investigation of the Flow Field of a Ceiling Fan," ASME Heat Transfer/Fluids Engineering Summer Conference, Paper No. HT-FED-2004-56226 (Jul. 2004).
KC-135A in flight—closeup of winglet with attached tufts, Screenshot from http://www.dfrc.nasa.gov/gallery/Photo/KC-135/Small/EC79-11481.jpg, printed on Aug. 11, 2008.
KC-135A in flight-winglet study, EC79-11314, Screenshot from http://www.dfrc.nasa.gov/gallery/Photo/KC-135/Small/EC79-11314.jpg, printed Aug. 11, 2008.
KC-135A in flight-winglet study, EC79-11484, Screenshot from http://dfrc.nasa.gov/galley/Photo/KC-135/Small/EC79-11484.jpg, printed Aug. 11, 2008.
Montoya, L.C., KC-135 Winglet Flight Results, NASA Dryden Flight Research Center, pp. 145-156.
NASA Dryden Technology Facts-Winglets, Screenshot from http://www.nasa.gov/centers/dryden/about/Organizations/Technology/Facts/TF-2004-15-D, printed on Aug. 11, 2008.
Screenshots from www.b737.org.uk, relating winglets, printed May 2004.
Screenshots from oea.larc.nasa.gov, relating to winglets, printed May 2004.
Screenshots from Penn State Engineering website, relating to winglets, printed May 2004.
"Technical Guide: Commercial Industrial & Special Application Ceiling Fans," publisher and date unknown.
Winglet Detail, Screenshot from http://upload.wikimedia.org/wikipedia/commons/5/53/Wingletdetail.jpg, printed on Aug. 11, 2008.
Wingtip Device, screenshot from http://en.wikipedia.org/wiki/Wingtip_device, printed Aug. 11, 2008.
Image: Winglet and nav light arp.jpg, Screenshot from http://en.wikipedia.org/wiki/Image:Winglet_and_nav_light_arp.jpg, printed Aug. 11, 2008.
747-400, Screenshot from http://www.boeing.com/commercial/747family/pf/pf_exterior.html, printed on Aug. 11, 2008.

* cited by examiner

ANGLED AIRFOIL EXTENSION FOR FAN BLADE

PRIORITY

This application is a continuation of U.S. Non-Provisional application Ser. No. 12/038,873, entitled "Angled Airfoil Extension for Fan Blade," filed Feb. 28, 2008, which claims priority from the disclosure of U.S. Provisional Patent Application Ser. No. 60/892,339, having the same title, filed on Mar. 1, 2007, the disclosures of which are incorporated by reference herein.

BACKGROUND

A variety of fan systems have been made and used over the years in a variety of contexts. For instance, various ceiling fans are disclosed in U.S. Pat. No. 7,284,960; U.S. Pat. No. 6,244,821; and U.S. Pat. No. 6,939,108. The disclosures of each of those U.S. patents are incorporated by reference herein. Another exemplary fan is disclosed in U.S. Pat. No. 8,079,823, entitled "FAN BLADES," issued Dec. 20, 2011, the disclosure of which is also incorporated by reference herein. Alternatively, any other suitable fans may be used in conjunction with versions described herein.

The outer tip of a fan blade or airfoil may be finished by the addition of an aerodynamic tip or winglet. Merely exemplary winglets are described in U.S. Pat. No. 7,252,478, the disclosure of which is incorporated by reference herein. Additional winglets are described in U.S. Pat. No. 7,934,907, entitled "CUFFED FAN BLADE MODIFICATIONS," issued May 3, 2011, the disclosure of which is incorporated by reference herein. In other variations, an angled extension may be added to a fan blade or airfoil, such as the angled fan blade extensions described in U.S. Provisional Patent Application Ser. No. 60/892,339, entitled "ANGLED AIRFOIL EXTENSION FOR FAN BLADE," filed Mar. 1, 2007, the disclosure of which is incorporated by reference herein. Other suitable structures that may be associated with an outer tip of an airfoil or fan blade will be apparent to those of ordinary skill in the art. Alternatively, the outer tip of an airfoil or fan blade may be simply closed, or may lack any similar structure at all.

The interface of a fan blade and a fan hub may also be provided in a variety of ways. For instance, an interface component is described in U.S. Provisional Patent Application Ser. No. 60/975,230, entitled "AERODYNAMIC INTERFACE COMPONENT FOR FAN BLADE," filed Sep. 26, 2007, the disclosure of which is incorporated by reference herein. Alternatively, the interface of a fan blade and a fan hub may include any other component or components, or may lack any similar structure at all.

Fans may also include a variety of mounting structures. For instance, a fan mounting structure is disclosed in U.S. Provisional Patent Application Ser. No. 60/972,890, entitled "CEILING FAN WITH ANGLED MOUNTING," filed Sep. 17, 2007, the disclosure of which is incorporated herein. In addition, a fan may include sensors or other features that are used to control, at least in part, operation of a fan system. For instance, such fan systems are disclosed in U.S. Provisional Patent Application Ser. No. 60/978,860, entitled "CEILING FAN WITH CONCENTRIC STATIONARY TUBE AND/OR SAFETY FEATURES," filed Oct. 10, 2007, the disclosure of which is incorporated by reference herein; U.S. Provisional Patent Application Ser. No. 61/025,852, entitled "AUTOMATIC CONTROL SYSTEM FOR CEILING FAN BASED ON TEMPERATURE DIFFERENTIALS," filed Feb. 4, 2008, the disclosure of which is incorporated by reference herein; and U.S. Provisional Patent Application Ser. No. 60/014,948, entitled "AUTOMATIC CONTROL SYSTEM TO MINIMIZE OSCILLATION IN CEILING FANS," filed Dec. 19, 2007, the disclosure of which is incorporated by reference herein. Alternatively, any other suitable mounting structures and/or fan systems may be used in conjunction with versions described herein.

It may also be desirable in some settings for the output airflow from a fan to spread outward across a relatively broad area rather than being concentrated in a vertical column below the fan.

While a variety of components and features have been incorporated into fans and fan systems, it is believed that no one prior to the inventor has made or used the invention described in the appended claims.

BRIEF DESCRIPTION OF THE DRAWINGS

The accompanying drawings incorporated in and forming a part of the specification illustrate several aspects of the present invention, and together with the description serve to explain the principles of the invention; it being understood, however, that this invention is not limited to the precise arrangements shown. In the drawings, like reference numerals refer to like elements in the several views. In the drawings.

Reference will now be made in detail to the present preferred version of the invention, an example of which is illustrated in the accompanying drawings.

Figure 8:
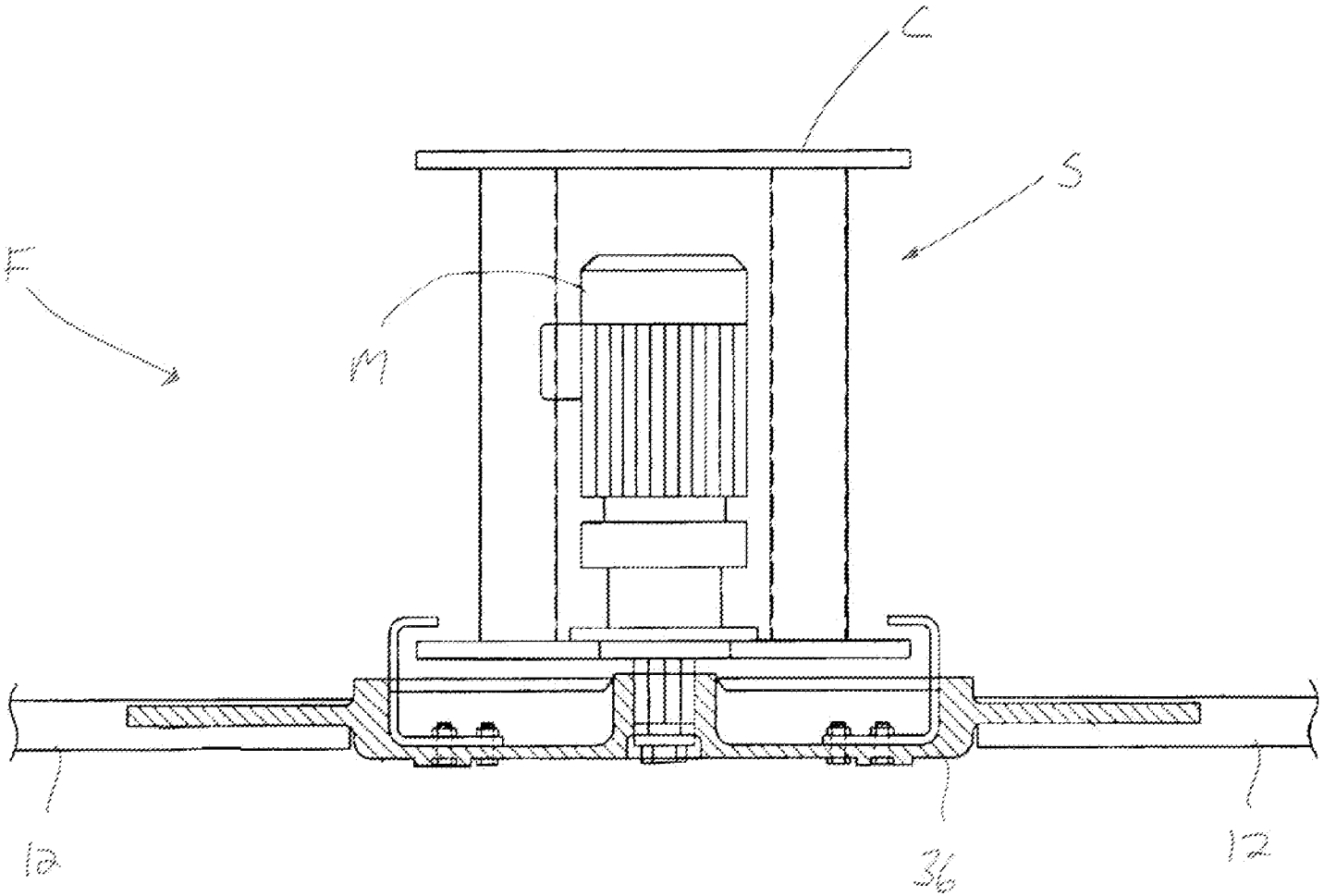

FIG. 8 illustrates an embodiment of a fan including a motor above the hub supporting the fan blades.

DETAILED DESCRIPTION

The following description of certain examples of the invention should not be used to limit the scope of the present invention. Other examples, features, aspects, versions, and advantages of the invention will become apparent to those skilled in the art from the following description, which is by way of illustration, one of the best modes contemplated for carrying out the invention. As will be realized, the invention is capable of other different and obvious aspects, all without departing from the invention. Accordingly, the drawings and descriptions should be regarded as illustrative in nature and not restrictive.

Figure 1:
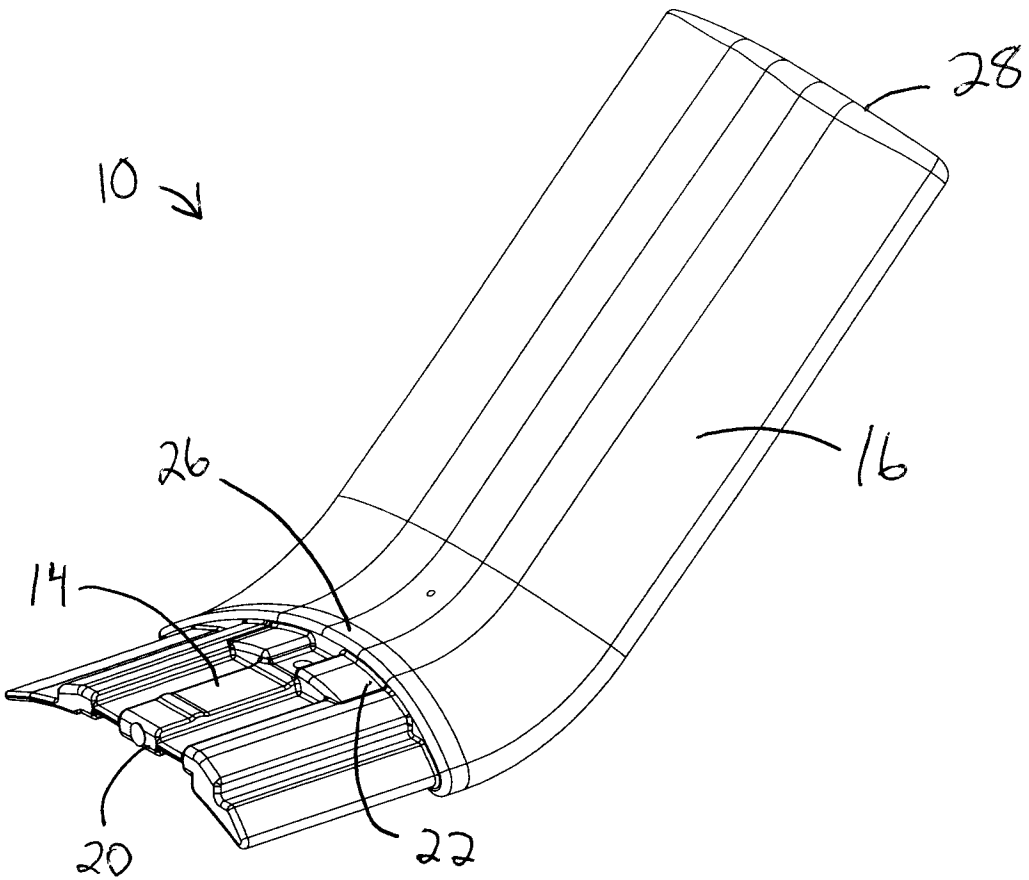
FIG. 1 is a perspective view of an exemplary angled fan blade extension.
Figure 2:
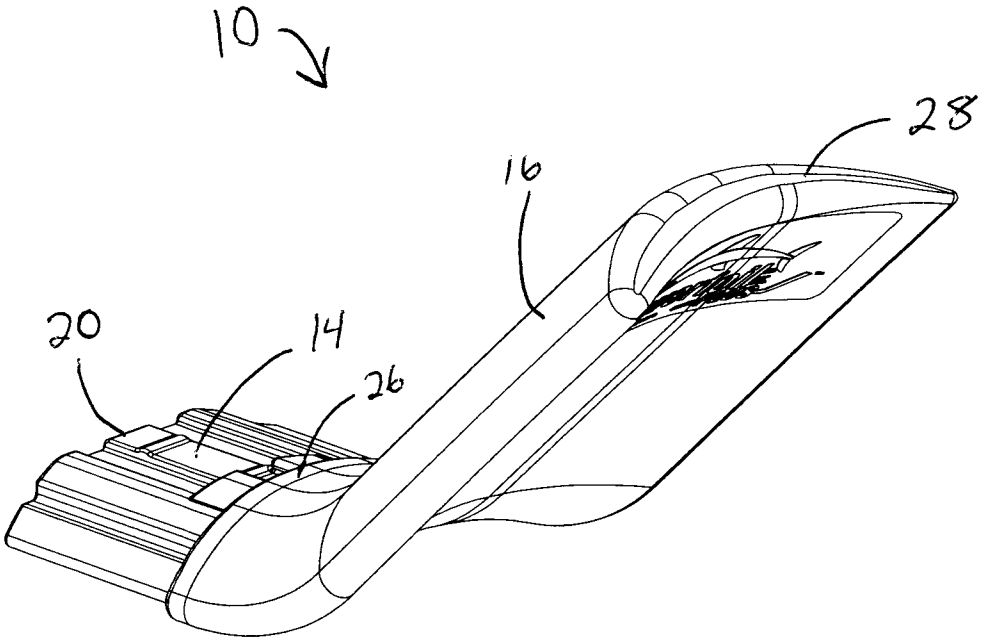
FIG. 2 is an alternate perspective view of the angled fan blade extension of FIG. 1.
Figure 6:
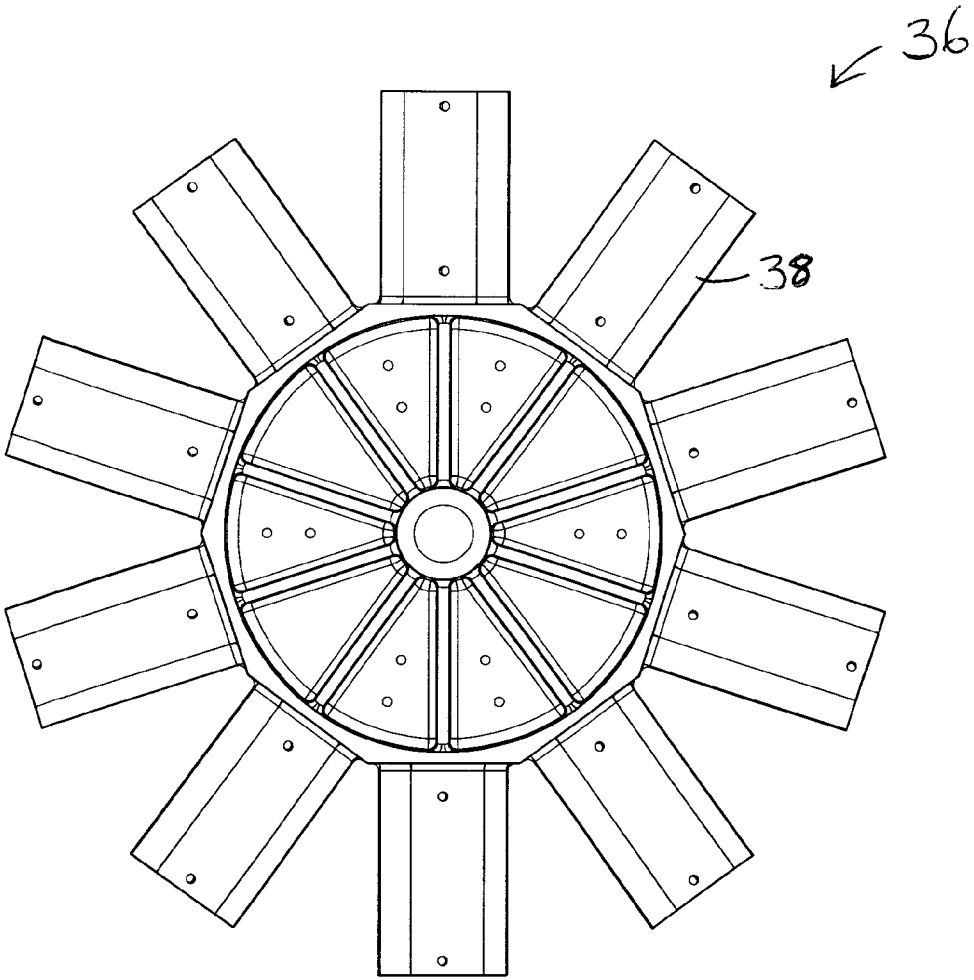
FIG. 6 is a plan view of a hub for mounting fan blades.
Figure 7:
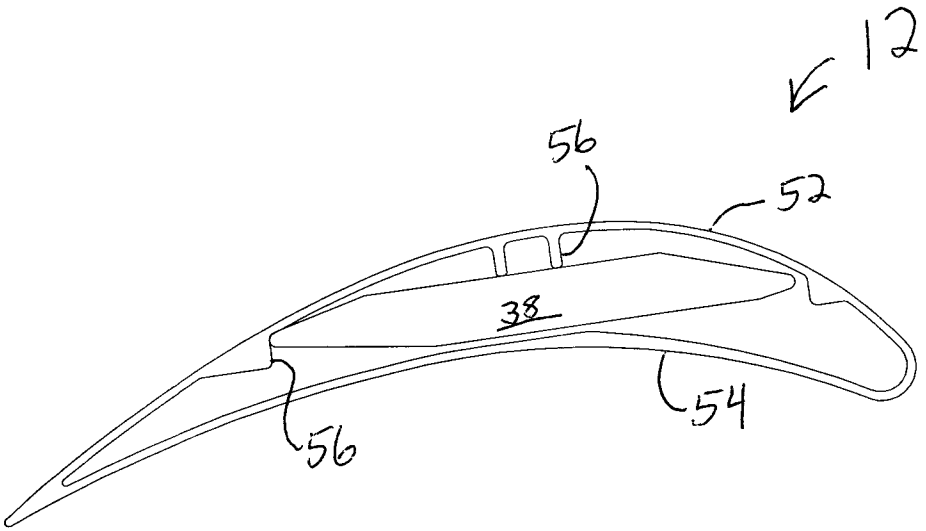
FIG. 7 is cross-sectional view of the exemplary fan blade of FIG. 4.

Referring now to the drawings in detail, wherein like numerals indicate the same elements throughout the views, FIGS. 1 and 2 show exemplary angled fan blade extension (10), which may be used with a fan (not shown) having one or more fan blades (12) in the form of airfoils. Referring to FIGS. 6 and 7, those of ordinary skill in the art will appreciate that a fan may generally comprise a hub portion (36), including a plurality of hub mounting members (38), to which one or more fan blades (12) may be mounted. Suitable examples of fans, hub portions (36), and fan blades (12) with which extensions (10) may be used are disclosed in the various patents, patent publications, and patent applications cited previously herein, though others may also be used.

Fan blade (12) of the present example is formed of extruded aluminum, though any other material(s) or methods of forming a fan blade (12) may be used. Fan blade (12) of the present example has an upper surface (52) with a generally elliptical curvature and a lower surface (54) with a generally elliptical curvature. Suitable methods of forming and elliptical configurations for a fan blade (12) are disclosed in U.S. Pat. No. 7,284,960, entitled "FAN BLADES," the disclosure of which is incorporated by reference herein. Alternatively, upper surface (52) and lower surface (54) may have any other suitable curvature or configuration. Fan blade (12) of the present example is also substantially hollow, and has a plurality of bosses (56) extending inwardly in the interior of fan blade (12). Bosses (56) are configured to engage mounting members (38) of hub portion (36) as shown in FIG. 7. Of course, a fan blade (12) may alternatively be substantially solid and/or may have any other suitable internal structures in addition to or in lieu of bosses (56). A fan blade (12) may also engage a hub portion (36) in any other desired fashion.

In the present example, angled fan blade extension (10) includes attachment portion (14) and angled portion (16). Attachment portion (14) has a proximal end (20) and a distal end (22). Angled portion (16) has a proximal end (26) and a distal end (28). The proximal end (26) of angled portion (16) is secured to the distal end (22) of attachment portion (14). In some versions, attachment portion (14) and angled portion (16) are formed separately, then joined together using fasteners (e.g., bolts, etc.), interlocking components or features, press fitting, adhesives, welding, or any other suitable devices, structures, or techniques. In some other versions, attachment portion (14) and angled portion (16) are formed as a unitary construction (e.g., molded as a homogenous continuum of material, etc.). Other ways in which attachment portion (14) and angled portion (16) may be formed will be apparent to those of ordinary skill in the art in view of the teachings herein. The proximal end (20) of attachment portion (14) is secured to the distal end (30) of fan blade (12) as described in greater detail below.

In some versions, the association of angled fan blade extension (10) to fan blade (12) provides a continuation of the cross sectional profile of fan blade (12). However, rather than continuing along the axis of fan blade (12), the association of angled fan blade extension (10) to fan blade (12) creates an upwardly curved angle configured to create a pattern of outward spread in the output airflow column. It will be appreciated by those of ordinary skill in the art that other angular orientations may be used. Along angled portion (16), the aerodynamic properties and angled orientation of angled portion (16) may tend to deflect the air downward and outward in a direction perpendicular to the axis of angled portion (16) of angled fan blade extension (10). Such a deflection may create an effect of an outwardly spreading column of air below the fan. Those of ordinary skill in the art will appreciate that other effects may be created in addition to or as an alternative to an outwardly spreading column of air below the fan. By way of example only, the angle of angled fan blade extension (10) may be such to similarly direct an outward flow of air at about the height of the fan. Also by way of example only, the angled fan blade extension (10) may be oriented such that the association of angled fan blade extension (10) to fan blade (12) creates a downwardly curved angle configured to create a pattern of inward spread in the output airflow column.

In some versions, the angle between fan blade (12) and angled portion (16) of angled fan blade extension (10) may have a tendency to disrupt vortices which form at distal end (28) of angled portion (16) of angled fan blade extension (10). This disruption of vortices may, to some extent, achieve the efficiency gains realized by the winglets described in U.S. Pat. No. 7,252,478 (incorporated by reference above). Angled fan blade extension (10) may also be formed with, fitted with, or otherwise include a winglet such as one described in U.S. Pat. No. 7,252,478.

Figure 4:
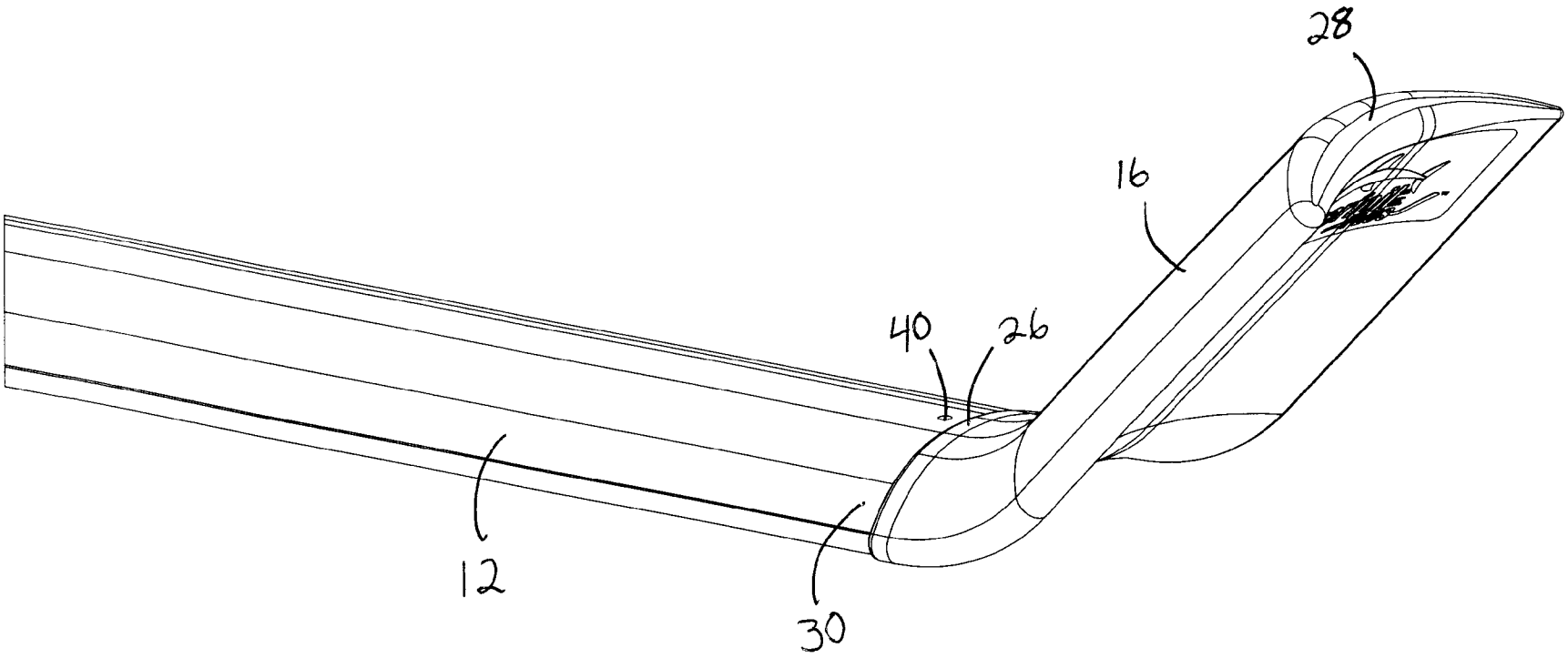
FIG. 4 is a perspective view of the angled fan blade extension of FIG. 1 installed on an exemplary fan blade.
Figure 5:
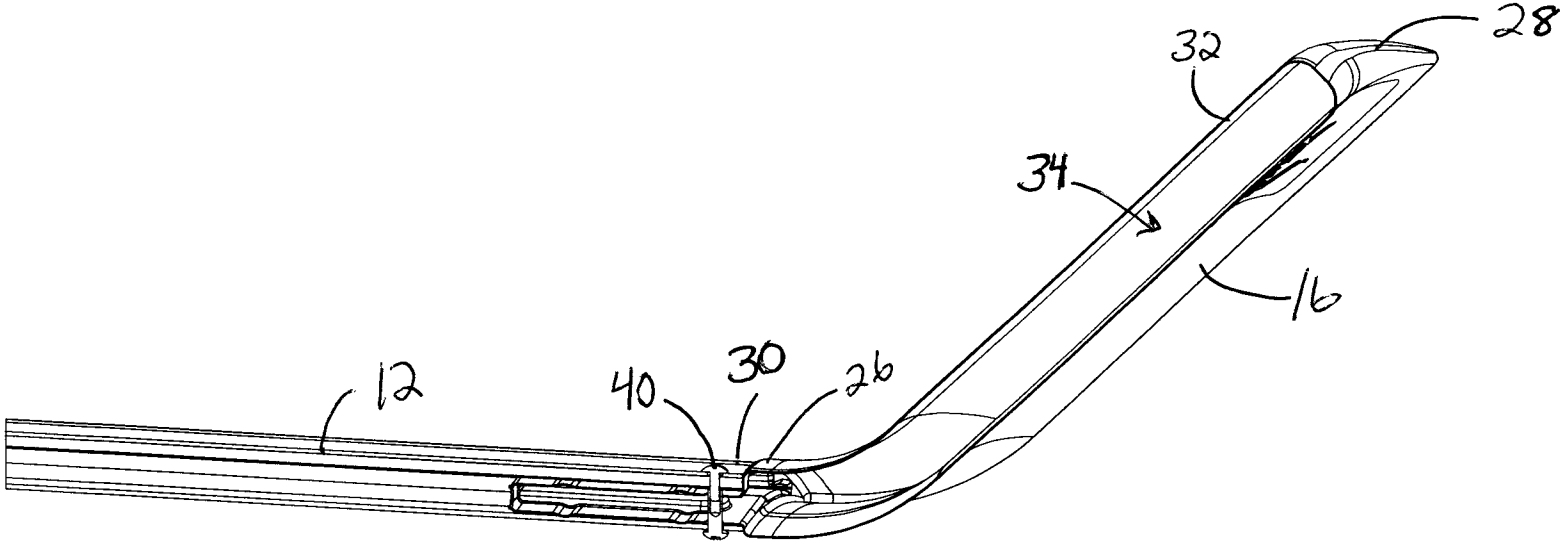
FIG. 5 is a cross-sectional view of the angled fan blade extension and fan blade of FIG. 4.

Now referring to FIGS. 4 and 5, in some versions, the angle between the axis of fan blade (12) and the axis of angled portion (16) of angled fan blade extension (10) may be between approximately 30 degrees, inclusive, and approximately 60 degrees, inclusive. For instance, the angle between the axis of fan blade (12) and the axis of angled portion (16) of angled fan blade extension (10) may be approximately 45 degrees. Alternatively, the angle between the axis of fan blade (12) and the axis of angled portion (16) of angled fan blade extension (10) may be between approximately 40 degrees, inclusive, and approximately 50 degrees, inclusive; between approximately 30 degrees, inclusive, and approximately 60 degrees, inclusive; between approximately 25 degrees, inclusive, and approximately 65 degrees, inclusive; between approximately 20 degrees, inclusive, and approximately 70 degrees, inclusive; or between approximately 10 degrees, inclusive, and approximately 80 degrees, inclusive. Of course, any other suitable angular relationships may be used.

In some versions, the length of angled portion (16) may be between approximately ¼ and approximately 1/12 of the length of associated fan blade (12), inclusive. Alternatively, any other suitable length relationships may be used.

In some versions, angled fan blade extension (10) is made of a lightweight polymer material to minimize its weight. Alternatively, any other suitable material or materials may be used, including but not limited to any suitable plastic, metal, composite, alloy, or combinations thereof.

Figure 3:
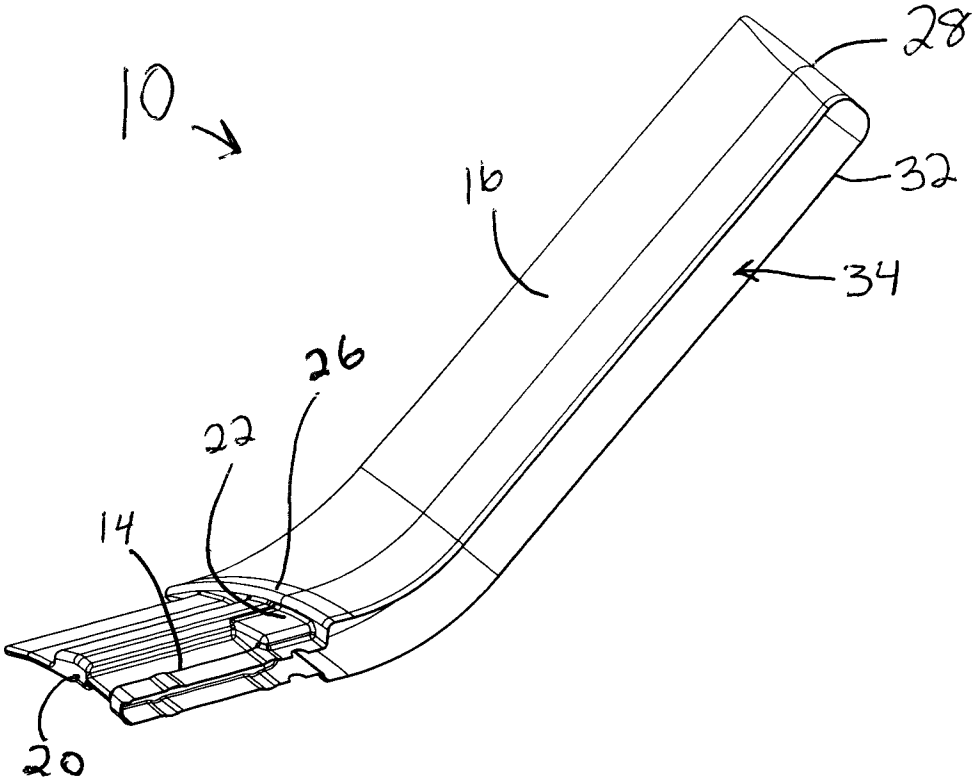
FIG. 3 is a cross-sectional view of the angled fan blade extension of FIG. 1.

Now referring to FIGS. 3 and 5, angled fan blade extension (10) may comprise a hollow form having a hollow space (34) defined by a relatively thin wall (32), to further minimize the weight of angled fan blade extension (10) while maintaining the full detail of the desired fan blade cross section form. Alternatively, angled fan blade extension (10) may be solid or have a substantially solid exterior and partially solid interior. It will also be appreciated that angled fan blade extension (10) may initially comprise a hollow form, with a material being used to fill the hollow form to any suitable degree.

The manufacturing process used in the production of angled fan blade extension (10) may include blow molding, rotational molding, injection molding, permanent mold casting, die-casting, stamping, welding, or any other suitable manufacturing process(es), including combinations thereof.

By way of example only, angled fan blade extension (10) may be used with a fan blade (12) having any of the various cross section forms described in U.S. Pat. No. 7,284,960, entitled "Fan Blades," issued Oct. 23, 2007, which is incorporated by reference herein, or any of those described in any of the other patents, patent publications, and patent applications cited previously herein. It will also be appreciated that angled fan blade extension (10) may have any suitable cross section form. For instance, at least a portion of an angled fan blade extension (10) may have a cross section form similar to the cross section form of a fan blade (12) to which it is secured. At least a portion of an angled fan blade extension (10) may also have a cross section form that differs from the cross section of a fan blade (12) to which it is secured. In addition, distal end (28) of angled portion (16) of angled fan blade extension (10) may be substantially flat, rounded (e.g. convex, etc.), tapered, or have any other suitable configuration. In the example shown in FIG. 2, angled portion (16) of angled fan blade extension (10) has an arcuate cross section form with a rounded distal end (28) of angled portion (16). For instance, angled fan blade extension (10) may have generally elliptical upper and lower surfaces, similar to fan blade (12).

In some versions, angled fan blade extension (10) is secured to fan blade (12) using any suitable technique. By way of example only, the end of fan blade (12) may be substantially hollow, and angled fan blade extension (10) may comprise attachment portion (14) configured to be inserted into the end of fan blade (12). Alternatively, the end of attachment portion (14) of angled fan blade extension (10) may be substantially hollow, and the end of fan blade (12) may be configured to be inserted into the end of attachment portion (14). For instance, attachment portion (14) may be modified to include a cuff, similar to the winglets described in Non-Provisional U.S. Pat. No. 7,934,907, entitled "CUFFED FAN BLADE MODIFICATIONS," issued May 3, 2011, the disclosure of which is incorporated by reference herein. Still yet, attachment portion (14) may be configured to slide over a portion of the end of fan blade (12) to establish connectivity. Furthermore, angled fan blade extension (10) may lack an attachment portion (14) altogether. For instance, angled portion (16) may be secured directly to fan blade (12) by separately forming angled portion (16) and fan blade (12), then joining them together using fasteners (e.g., bolts, etc.), interlocking components or features, press fitting, adhesives, welding, or any other suitable devices, structures, or techniques. In some other versions that lack an attachment portion (14) altogether, angled portion (16) and fan blade (12) may be formed as a unitary construction (e.g., molded as a homogenous continuum of material, etc.). Other suitable engagement configurations and relationships will be apparent to those of ordinary skill in the art.

It will also be appreciated that one or more fasteners may be used to secure attachment portion (14) to fan blade (12), including but not limited to one or more pins, screws, bolts, adhesives, nails, welds, etc. In the present example, a screw post fastener (40) is used to secure attachment portion (14) to fan blade (12). In yet another version, fan blade (12) and attachment portion (14) of angled fan blade extension (10) are integrally formed of a homogenous continuum of material. For instance, angled fan blade extension (10) may simply comprise the distal end (30) of fan blade (12) bent upward. It will be appreciated by those of ordinary skill in the art that such a bent configuration may include bending the distal end (30) of fan blade (12) in a variety of directions to achieve the desired angular configuration.

In some versions of angled fan blade extension (10), attachment portion (14) has substantially flat upper and lower surfaces (e.g., defining substantially flat, substantially parallel planes, etc.). For instance, attachment portion (14) may be configured similar to mounting members (38) of hub portion (36). Alternatively, as shown in FIGS. 1-3, attachment portion (14) may have a center region and/or upper and lower surfaces having a curvature that is substantially similar to or complements a curvature of one or both fan blade (12) surfaces (52, 54). For instance, upper and lower surfaces of attachment portion (14) may each have a generally elliptical curvatures; and/or a center region of attachment portion (14) may have a generally elliptical curvature. Furthermore, upper and lower surfaces of attachment portion, regardless of whether they are curved or substantially flat, may also include one or more recesses, relief features, or other features configured to engage with bosses (56) inside fan blade (12). In some versions, a pattern of thicker and thinner sections across attachment portion (14) may provide additional stiffness and/or resistance to crushing. Other suitable configurations and features for an attachment portion (14) will be apparent to those of ordinary skill in the art in view of the teachings herein.

Having shown and described various versions of the present invention, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

FIG. 8 illustrates a fan motor (M) positioned above and rotatably supporting the hub portion (38) carrying the blades (12). When actuated, the motor (M) causes the fan blades (12) to rotate. The arrangement also includes a support (S) adapted to allow the mounting of the fan assembly (F) to the ceiling (C).

What is claimed is:

1. An apparatus for a fan blade having one or more bosses extending inwardly relative to a surface of the fan blade, comprising:

(a) an attachment portion having a distal end; and (b) an angled portion, wherein the angled portion extends from the distal end of the attachment portion such that the attachment portion and the angled portion form a homogeneous continuum of material;

wherein the attachment portion is configured to insert into a first end of the fan blade and engage the one or more bosses; and wherein the angled portion extends vertically at a non-perpendicular, non-parallel angle relative to the fan blade when the attachment portion is inserted into the first end of the fan blade; and wherein the attachment portion and the angled portion collectively define a substantially hollow interior.

2. The apparatus of claim 1, wherein the attachment portion comprises one or more recesses, wherein the one or more recesses are configured to receive the one or more bosses when the attachment portion is inserted into the first end of the fan blade.

3. The apparatus of claim 2, further comprising a fastener, wherein the fastener is insertable through the attachment portion, wherein the fastener is configured to secure the attachment portion relative to the first end of the fan blade.

4. The apparatus of claim 3, wherein the attachment portion comprises an upper attachment surface having a first curvature complementary with a second curvature of an upper blade portion of the fan blade.

5. The apparatus of claim 1 wherein the angled portion extends downwardly relative to the fan blade.

6. The apparatus of claim 1 wherein the angled portion comprises a distal end, wherein the distal end comprises a flat surface.

7. The apparatus of claim 1 wherein the angled portion is oriented to deflect air inwardly relative to the fan blade.

8. The apparatus of claim 1 wherein the angled portion is oriented to deflect air downwardly relative to the fan blade.

9. The apparatus of claim 1 wherein at least a segment of the attachment portion comprises a first outer profile substantially identical to a second outer profile of the fan blade.

10. The apparatus of claim 1 wherein the non-perpendicular, non-parallel angle of the angled portion relative to the fan blade comprises an angle between 10 degrees and 80 degrees in a vertical direction when the attachment portion is inserted into the first end of the fan blade.

11. A fan comprising:

(a) a hub;

(b) at least one fan blade having a first end and a second end, wherein the second end is coupled to the hub such that the hub is operable to rotate the at least one fan blade, wherein the first end comprises at least one boss located in a recessed portion and an upper blade portion at least partially defining the recessed portion, wherein the upper blade portion comprises a first curvature; and (c) an extension comprising:

i. an attachment portion having a proximal end and a distal end, wherein the proximal end of the attachment portion comprises an upper attachment surface having a second curvature, and ii. an angled portion, wherein the angled portion extends from the distal end of the attachment portion, wherein the attachment portion is configured to insert into the recessed portion of the fan blade such that the extension to the fan blade provides a continuation of the cross-sectional profile of said fan blade;

wherein the first curvature and the second curvature are complementary, wherein the angled portion extends from the attachment portion at a non-perpendicular, non-parallel angle relative to the fan blade when the attachment portion is inserted into the first end of the fan blade, wherein the proximal end of the attachment portion engages with the at least one boss when the extension is coupled to the at least one fan blade.

12. The fan of claim 11 wherein the angled portion extends downwardly relative to the fan blade.

13. The fan of claim 11 comprising a fastener, wherein the fastener is insertable through the first end of the at least one fan blade and the attachment portion of the extension, wherein the fastener is configured to secure the attachment portion relative to the first end of the fan blade.

14. The fan of claim 11, wherein the upper blade portion includes an outer fan blade surface.

15. The fan of claim 11, wherein the angled portion extends upwardly relative to the fan blade.

16. The fan of claim 11, wherein the angled portion comprises an arcuate surface.

17. The fan of claim 11, wherein the angled portion comprises a convex upper surface.

18. The fan of claim 11, wherein the distal end of the angled portion is tapered.

19. A fan comprising:

(a) a hub;

(b) at least one fan blade having a first end and a second end, wherein the fan blade defines a substantially hollow interior extending from the first end to the second end, wherein the second end is coupled to the hub such that the hub is operable to rotate the at least one fan blade; and (c) an extension comprising:

i. an attachment portion having a distal end, and ii. an angled portion, wherein the angled portion extends from the distal end of the attachment portion, wherein the attachment portion is configured to insert into the first end of the at least one fan blade;

wherein the angled portion extends at a downward angle relative to the at least one fan blade when the attachment portion is inserted into the first end of the at least one fan blade, wherein the attachment portion and the angled portion collectively define a substantially hollow interior.

20. A fan for being supported from a ceiling, comprising:

(a) a motor;

(b) a support for supporting the motor from the ceiling;

(c) a rotatable hub suspended from the motor;

(d) at least one fan blade having a first end and a second end, wherein the second end is coupled to the hub such that the hub is operable to move the at least one fan blade, and (e) an extension comprising i. an attachment portion having a proximal end and a distal end; and ii. an angled portion extending from the distal end of the attachment portion at a non-perpendicular, non-parallel angle relative to the fan blade when the proximal end of the attachment portion is inserted into the first end of the fan blade wherein the attachment portion and the angled portion collectively define a substantially hollow interior.

21. A fan for being supported from a ceiling, comprising:

(a) a motor;

(b) a support for supporting the motor from the ceiling;

(c) a rotatable hub suspended from the motor;

(d) at least one fan blade having a first end and a second end, wherein the second end is coupled to the hub such that the hub is operable to move the at least one fan blade, and (e) an extension comprising i. an attachment portion having a proximal end and a distal end; and ii. an angled portion extending from the distal end of the attachment portion at a non-perpendicular, non-parallel angle relative to the fan blade when the proximal end of the attachment portion is inserted into the first end of the fan blade, wherein the attachment portion is configured to insert into the fan blade such that the extension to the fan blade provides a continuation of the cross-sectional profile of said fan blade.

* * * * *